US007268689B2

(12) United States Patent
Sulaver

(10) Patent No.: US 7,268,689 B2
(45) Date of Patent: Sep. 11, 2007

(54) ALERTING AND INTRUDER DETERRING DEVICE

(76) Inventor: John A. Sulaver, 20640 Rodriguez Ave., Cupertino, CA (US) 95014

( * ) Notice: Subject to any disclaimer, the term of this patent is extended or adjusted under 35 U.S.C. 154(b) by 550 days.

(21) Appl. No.: 10/672,813

(22) Filed: Sep. 25, 2003

(65) Prior Publication Data

US 2004/0061614 A1 Apr. 1, 2004

Related U.S. Application Data

(60) Provisional application No. 60/413,945, filed on Sep. 26, 2002.

(51) Int. Cl.
*G08B 23/00* (2006.01)

(52) U.S. Cl. ..... 340/573.1; 340/573.7; 340/541

(58) Field of Classification Search ..... 340/541, 340/545.2, 545.3, 550, 551, 552, 555, 556, 340/573.1, 573.3, 573.4, 573.7; 119/713; 345/204, 473

See application file for complete search history.

(56) References Cited

U.S. PATENT DOCUMENTS 4,912,457 A 3/1990 Ladd
5,450,063 A * 9/1995 Peterson et al. ..... 340/573.2
5,726,629 A 3/1998 Yu
5,760,686 A 6/1998 Toman
5,892,446 A 4/1999 Reich
5,971,597 A * 10/1999 Baldwin et al. ..... 700/277
6,118,458 A * 9/2000 Kawai et al. ..... 345/473
6,127,926 A * 10/2000 Dando ..... 340/541
6,249,278 B1 * 6/2001 Segan et al. ..... 345/204
6,323,773 B1 11/2001 Ranyon
6,710,705 B1 * 3/2004 Smith et al. ..... 340/384.2

OTHER PUBLICATIONS www.pentagondefense.com; www.womwndefensecenter.com(Electronic Watch Dog), 2003.
www.1stlinesecurity.com (Electronic Watch Dog, Eelctronic Guard Dog), 2003.
www.nservices.com (Rex-Plus Eelctronic Watch Dog), 2003.

* cited by examiner

*Primary Examiner*—Van T. Trieu
(74) *Attorney, Agent, or Firm*—Foothill Law Group, LLP; Barton A. Smith; Anthony Delas

(57) ABSTRACT

The invention relates generally to the field of warning signs intended to alert one of presence of an animal and intruder deterrence. More specifically, the invention integrates an adjustable motion detector, a warning sign, a light source aimed at the warning sign, an audio announcement and a replica of an animal or other image with another light source for its illumination. The motion detector senses the presence of a person and sends an activation signals to the audio and light sources. The first light source illuminates the warning sign, while the second light source illuminates the replica of an animal or other warning image, adding a sense of a realistic warning to a casual passer-by and a threat to the intruder.

32 Claims, 3 Drawing Sheets

ALERTING AND INTRUDER DETERRING DEVICE

This application claims the benefit of the U.S. Provisional Application No. 60/413,945, filed Sep. 26, 2002.

BACKGROUND OF THE INVENTION

This invention relates to "beware of" alerting signs commonly used on gates and fences of homes, buildings and other properties and alarm devices intended to warn of presence of a guard dog, or to deter an intruder and warn a property owner of presence of an intruder. More specifically, this invention relates to an alerting sign that is aesthetically more appealing, pronounced, realistic and forceful than the existing art, thus improving its effectiveness and encouraging the usage.

Devices warning of a presence of a guard animal, such as a dog, have been widely utilized around the world for a very long time. The most common beware of dog signs are plastic sheets with "Beware of Dog" printed on them. The usage of these signs is limited by their unattractive appearance which makes their acquisition less likely. Moreover, the effectiveness of such signs is compromised by wear due to poor quality of the materials employed in their construction and poor visibility under inadequate lighting conditions. The visibility problem is worsened in case of children who cannot read or others with impaired eyesight. Finally, such signs are not visible at night time at all. Their effectiveness in actually deterring an intruder is even lower, especially at night or under conditions of poor visibility.

Other means of warning, typically employing audio warnings and lighting fixtures have been employed to discourage intruders form entering the areas sought to be protected. The inherent limitation that all these devices have is their limited effectiveness as their threat is limited to the audio message or lighting up of a physical space. Similarly, visual information only, such as warning sign, is also inadequate as the amount of visual information in environment around us has reached the level of visual "pollution", making such devices alone easy to ignore, as the people likely to encounter them become accustomed and oblivious to excessive amount of visual information.

The inventions disclosed in following patents attempt to address these problem, but each has its limitations as it fails to integrate all the components of the warning into one forceful message.

U.S. Pat. Nos. 4,912,457 and 5,726,629 produce audio and visual warnings upon detecting a person, the '457 patent being used in industry to remind a machine operator about pertinent safeguards and the '629 patent discloses a home security application whereby the sound of a dog barking can be delivered to the intruder whose presence is detected.

U.S. Pat. No. 5,760,686 discloses a device that warns workers in a roadway work zone of an errant vehicle by the use of motion detectors targeting the perimeter of the zone and a strobe light array.

U.S. Pat. No. 6,323,773 discloses an alerting audio device based on the motion detector technology that also illuminates a sign to remind the persons of the nearby danger.

U.S. Pat. No. 5,726,629 discloses an invention combining heat seeking infrared sensors that, upon detecting heat radiation by the moving object, sends an electronic signal that activates a lighting fixture and an audio source to warn an intruder entering the area monitored by the motion detector.

U.S. Pat. No. 5,892,446 employees the approach similar to the U.S. Pat. No. 5,726,629 to detect the presence of an animal and to frighten it from the protected area.

There are other commercially available products that attempt to serve the same warning function. One of such products, Electronic Watch Dog by Pentagon Defense Products utilizes microwave technology to detect movement and activate a German Shepherd bark. Again, this is an audio warning only that lacks the visual reinforcement that a warning sign would provide and falls far short of the forceful effect of a warning replica of a guard dog.

The device of this invention eliminates the deficiencies described above, improves the warning sign visibility and combines an audio alarm with an illuminated replica of an animal or other suitable object for an enhanced effect.

SUMMARY OF THE INVENTION

The present invention overcomes the problems associated with the prior art by greatly enhancing the aesthetic appeal, visibility, durability and uniqueness of warning signs. An authentic life-like warning replica of a guard dog face gives realism to the present invention's look and feel. Popular dogs associated with a protective look could include a German Shepherd, Rottweiler, Doberman, etc. Life-like they present a much greater aesthetic appeal than the prior art, as they are more interesting and easier to notice.

The unique nature of the present invention allows for furthering the authenticity and forcefulness of the sign by using a motion detector to activate a sound, such as a dog growl, in conjunction with the eyes and other facial features being illuminated and animal jaw and ears moving at the same time. The motion detector is adjustable to activate upon a person approaching within certain distance of the property and will also include a manual on and off switch. This will enable the owner to have the flexibility to turn it off as needed. The word "Beware" or similar would be displayed near the life-like warning replica of an animal. Alternatively, the written warning could be located apart from the depiction. The illuminating eyes would allow for good visibility at night, while the auditory sound would warn visually impaired persons.

While providing a good warning, the present invention would be created out of a weather resistant material thus increasing the lifespan over the prior art. The animal face would protrude from the plaque design background. The plaque may be any shape, possibly circular, oval or square. The attractive appearance of the invention would make for a suitable decoration apart from its deterrent value.

In view of the above, the invention is advantageous in that it provides an improved device for warning of presence of a dangerous animal and to deter intruders.

Another advantage of the present invention is that it integrates audio and light alarm warnings with a life-like replica of a dangerous animal such as a guard dog.

A further advantage of the present invention is that it employees a manual on and off switch, thus enabling the owner to disable it as needed.

Still another advantage of the present invention is that it enables simultaneous or sequential activation of audio and light warnings.

It is also another advantage of the present invention to display life-like warning replicas of various vicious animals, thus further increasing an impact on the intruder.

In this application, the term "human warning sign" means an actual sign, designed to convey a warning to a human being.

Yet another advantage of the present invention is that it enables the warning sign and the warning replica to be positioned next to each other or apart from each other, thus creating two separate warnings and so further increasing the effect on the passer-by or the intruder.

The invention is also advantageous in that it may display a jaw of an animal in opening and closing motion, thus communicating an even more forceful warning.

Still another advantage of the present invention is that it lights up the eyes of the warning replica, making this a particularly effective warning at night time.

An added advantage of the present invention is that the warning sign may warn of one type of danger and the warning replica of an additional danger, thus further increasing the deterring effect.

DETAILED DESCRIPTION

The details of one or more embodiments of the invention are set forth in the accompanying drawings and the description below. Other features, objects and advantages of the invention will be apparent from the following descriptions and drawings.

Figure 1:
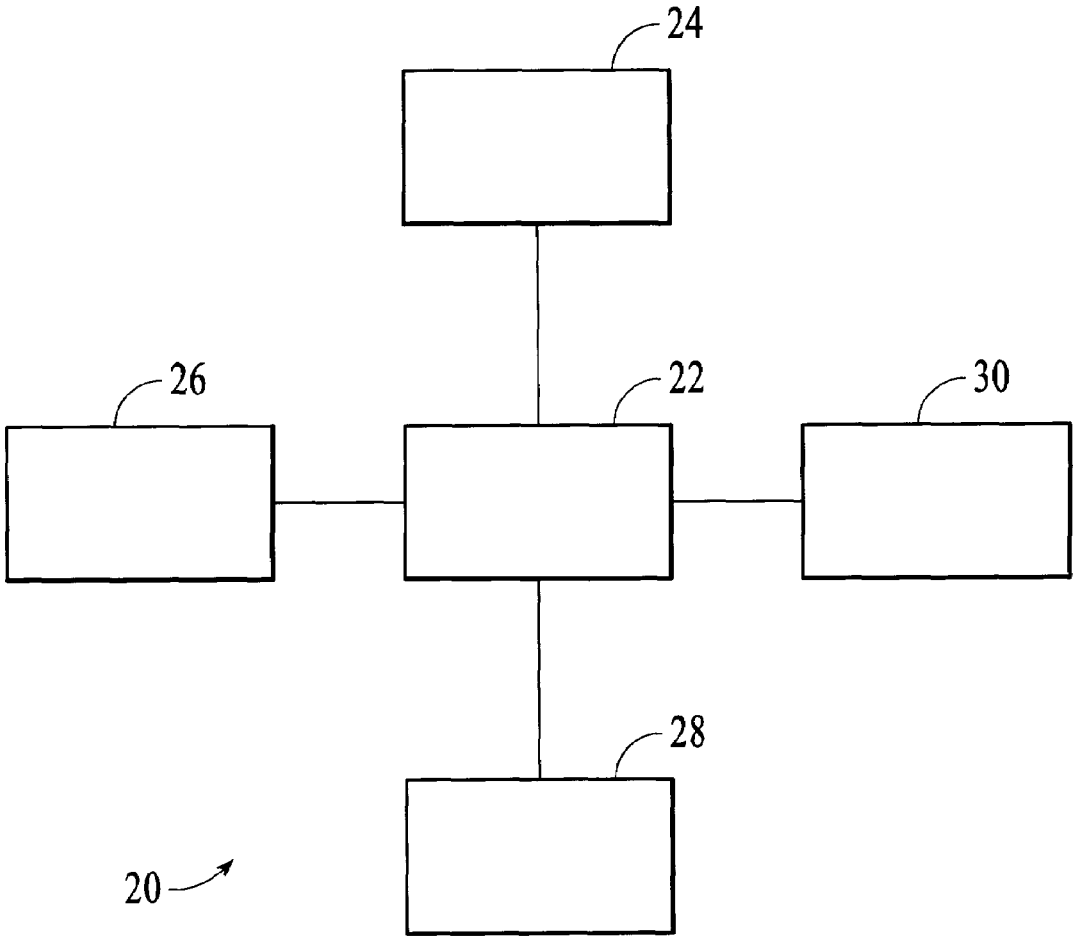
FIG. 1 is a block diagram of the invention.

Referring first to FIG. 1, a block diagram of the present invention, the alerting device 20 has a motion detector 26, a sending unit or a switch 22, announcement device with prerecorded message 30, a warning sign 24 with a light emitting device and the warning replica 28 with a light emitting device. The motion detector 26, the announcement device 30 and the light emitting devices and their associated power supplies are all commercially available off-the shelf items. The motion detector 26, the switch 22, the announcement device 30, the warning sign 24, the warning replica 28 may all be integrated in one unit, such as the device 60 in FIG. 2 or they may be only partially integrated or each unit may be a stand-alone unit. The motion detector 26 preferably has a manual on and off switch enabling to select operating time periods. The motion detector 26 may be a light beam motion detector, such as an infrared sensor motion detector or it may be an ultrasonic motion detector. An infrared detector is preferred as it does not send false alarms due to background noise as an ultrasonic motion detector may do. Preferably, the motion detector is adjustable to respond to varying lighting conditions. An infrared sensor of the motion detector 26 detects infrared thermal energy reflected by a person within its area of reach, converts the thermal energy into an electronic signal and sends the electronic signal to the switch 22.

The switch 22 transmits electronic signals to the announcement device 30 with a speaker connected thereto, the warning sign 24 and the warning replica 28. The announcement device 30 may be similar to a device employed in a telephone answering system or other recording devices. The announcement device 30 then plays a prerecorded message. The prerecorded message may be a siren sound, a buzzing sound, a bell, horn, a gun shot, a shriek, a yell, a shout, a scream, musical notes, an animal sound, words of warning, a dog growl, a dog bark, a specific announcement regarding the danger, or any other sound or combination of sounds that are likely to draw attention.

The switch 22 also transmits an electronic signal to the light source positioned to illuminate the warning sign 24. The warning sign 24 may simply state "Beware of Dog" or employ other words of caution or warning. The lighting source associated with the warning sign 24 would illuminate the warning sign 24. The lighting source may be integrated with the warning sign 24 or it may be separate form the warning sign 24.

Another portion of electronic signal generated by the motion detector 26 is transmitted by the switch 22 to the warning replica 28 and the light source associated therewith. The warning replica 28 may be of any desired size so long as it is visible under the circumstances. The warning replica 28 may be integrated with the warning sign 24 so that the words of warning and the warning replica 28 are one device or it may be at some distance from the warning sign 24, thus providing two separate warning sources. The warning replica 28 may be a replica of an animal face, an animal profile, animal jaws, a partial animal body, a complete animal body, a human skull, bones, skeleton, flashing police car lights, a police car, and any subject likely to draw attention. Preferably, the warning replica is chosen from the group of aggressive animals, such as: a dog, wolf, tiger, lion, leopard, cheetah, hyena. More preferably, the warning replica is chosen from a group of dogs such as any watch dog, German Shepard, Doberman, Rottweiler or similar. Preferably, the motion detector 26 is equipped with a timer that would shut off the motion detector 26 after a period of time.

The signal transmission between the motion detector 26 and other components of the invention may be accomplished by hard wiring, a fiber optic connection, or a wireless method.

Figure 2:
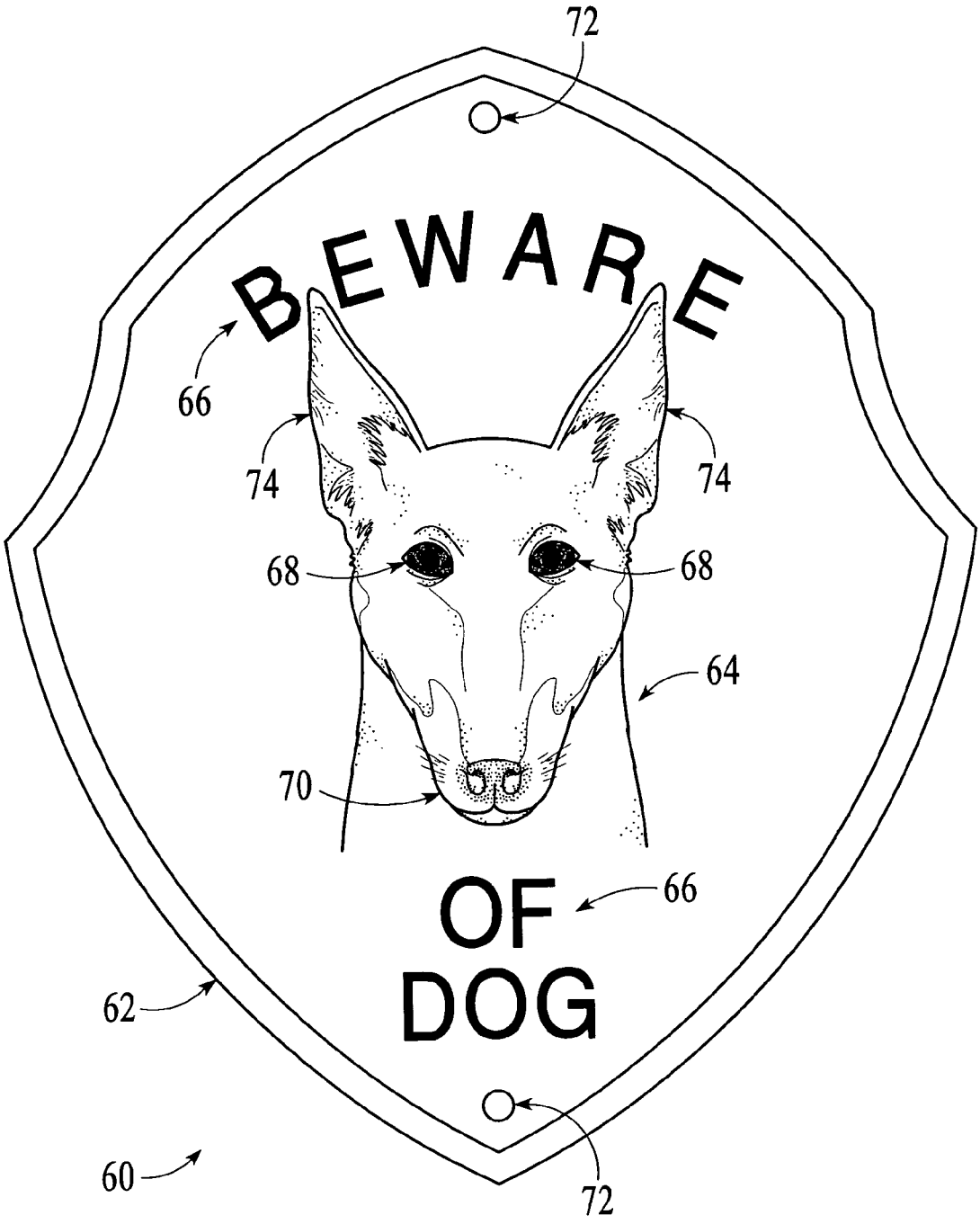
FIG. 2 shows the Beware of Dog sign with a life-like dog head.

The embodiment of FIG. 2 shows an integrated version of warning sign 24 and warning replica 28 as an illustration of a multiplicity of types of warning replicas 28 that may be utilized. Shown here in a way of illustration only and not as a limitations, replica 28 is chosen to represent a dog, more specifically, the dog head 64. The device 60 shows the housing 62 that accommodates "Beware of Dog" words 66, dog head 64, dog jaw 70, dog eyes 68, dog ears 74 and fastening points 72 for the housing 62. More than one dog head 64 may be employed, or the dog head 64 may be combined with another replica. Alternatively, any combination of replicas may be employed. A lighting source would preferably be positioned inside the dog head 64, so that it illuminates dog eyes 68 and dog jaw 70. Any color light may be chosen, but red light would be preferred. Illuminating the dog head 64 from inside would have a very dramatic effect on a passer-by who inadvertently approached the alerting device or upon an intruder who did not expect the presence of a guard animal or other warnings.

It is not essential that the words of warning 66 warn of the presence of the same type of animal as the warning replica shows, i.e., "Beware of Dog" sign may accompany a replica of a head of a tiger or a police car with flashing lights. In a case where only a warning of a presence of a dog is being communicated, the words of warning 66 will preferably describe the dog just as the warning replica does. Preferably, the illumination source is capable of an "on and off" operation adding a dimension of life to the warning replica. The illumination source may also be positioned externally to the device 60 and therefore the words of warning 66 and the entire warning replica would be illuminated externally. Also, the words of warning 66 may appear in a separate location from dog head 64 or another warning replica, thus creating two distinct warnings.

Figure 3:
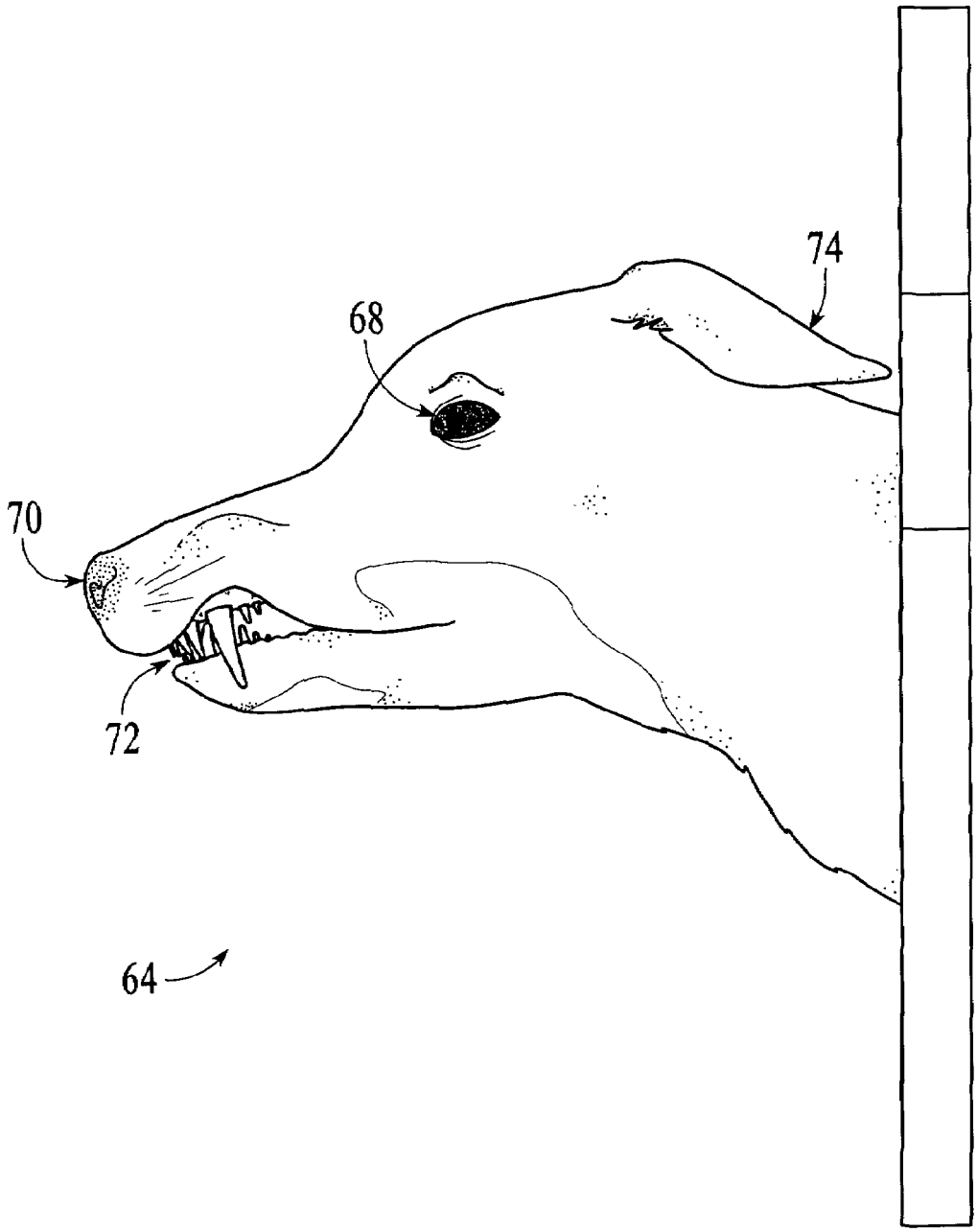
FIG. 3 is side view of the life-like dog head of FIG. 2.

Shown in FIG. 3 is a side view of dog head 64, showing dog jaw 70, dog eyes 68, dog ears 74, dog teeth and tongue 72. Preferably, dog jaw 70 is capable of opening and closing and dog ears are capable of moving between folded down and more vertical positions. Opening the dog jaw 70 would expose the dog teeth 72 and further increase the degree of apprehension in those approaching the area guarded by the alerting device. A person skilled in the art could easily choose a set of mechanical drive gears driven by small electric motors to accomplish these tasks. Preferably, the movement of dog jaw 70 can be contemporaneous with the playing of the prerecorded message or it can take place after the prerecorded message has been played.

In another embodiment, a warning replica may be separated from the movable portions of the animal, i.e., the movable portion such as dog jaw 70 may appear in a position apart form the warning replica which would be a stationary object. In such case the warning replica would include the dog head 64 with eyes 68 and ears 74. The dog jaw 70 with moving capability could be positioned elsewhere or totally omitted.

Preferably the device 60 is made by a molding process utilizing high density plastic material such as TEFLON ® for improved wear resistance. (TEFLON is a registered trademark of El Dupont de Nemours.)

Similarly, the alerting device 20 is preferably made portable for ease of relocation from one part of property to another.

A person skilled in the art will be able to select suitable devices and power supplies according to the electrical and optical specifications for each device. The power supply chosen may be a battery, solar or household current. A battery or solar power supplies are preferred as they're independent of the household current that may become disrupted.

A number of embodiments of the invention have been described. Nevertheless, it will be understood that various modifications may be made without departing from the spirit and scope of the invention. Therefore, the spirit and scope of the claims should not b limited to the description of the version contained herein.

What is claimed is:

1. An alerting device, comprising:

at least one motion detector;

an announcement device with a prerecorded message;

at least one light emitting device;

at least one warning replica at least one human warning sign;

at least one illumination means, a signal transmitting means operatively connecting said at least one motion detector to said announcement device, to said at least one warning replica, to said at least one human warning sign, to said illumination means; and a power source for supplying energy to said alerting device.

2. The device of claim 1, further comprising a manual on and off switch, said switch operatively connected to said alerting device.

3. The device of claim 1, wherein said at least one motion detector further comprises a timer.

4. The device of claim 1, wherein said alerting device is capable of being carried by a person.

5. The device of claim 1, wherein said at least one motion detector is a light beam motion detector.

6. The device of claim 5, wherein said light beam motion detector is an infrared detector.

7. The device of claim 1, wherein said at least one motion detector is an ultrasonic beam motion detector.

8. The device of claim 1, wherein said at least one motion detector generates a signal that enables said announcement device to play said prerecorded message and said at least one light emitting device to illuminate said at least one warning replica and said at least one human warning sign.

9. The device of claim 1, wherein said prerecorded message comprises at least one of a siren sound, a buzzing sound, a bell, a horn, a gun shot, a shriek, yell, shout, scream, musical notes, an animal sound, a dog growl, words of warning, specific announcement, and a dog bark.

10. The device of claim 1, wherein said power source comprises at least one of a battery, solar power and household current.

11. The device of claim 1, wherein said motion detector is adjustable to illuminate the at least one warning replica under varying lighting conditions.

12. The device of claim 1, wherein said at least one warning replica is positioned in the space defined by said at least one human warning sign.

13. The device of claim 1, wherein said at least one warning replica is positioned in the space beyond the space defined by said at least one human warning sign.

14. The device of claim 1, wherein said at least one warning replica comprises at least one of: animal face, animal profile, animal head, a partial animal body, a complete animal body, an animal or human skull, bones, skeleton, police car, flashing lights of a police car and any attention drawing subject.

15. The device of claim 14, wherein said animal face or animal body comprises at least one of a face, head and body of at least one of a dog, wolf, tiger, lion, leopard, cheetah, hyena and other vicious animal.

16. The device of claim 14, wherein said animal face, animal profile, animal head, animal body further comprise a movable portion, said movable portion being capable of changing its position contemporaneously or sequentially with said prerecorded message.

17. The device of claim 16, wherein said movable portion further comprises ears and jaw of an animal, said jaw being capable of opening and closing movements.

18. The device of claim 17, wherein said jaw further comprises at least one tooth and a tongue.

19. The device of claim 16, wherein said movable portion is detachably connected to said at least one warning replica.

20. The device of claim 16, wherein said movable portion is an integral part of said at least one warning replica.

21. The device of claim 1, wherein said at least one warning replica is made of weather resistant material.

22. The device of claim 21, wherein said weather resistant material is high density molded plastic.

23. The device of claim 22, wherein said high density plastic is TEFLON ®.

24. The device of claim 1, wherein said at least one light emitting device is positioned in the interior of said at least one warning replica, so as to illuminate said warning replica from within.

25. The device of claim 24, wherein said at least one light emitting device comprises at least one of ultraviolet, blue, yellow, orange, green and red colors.

26. The device of claim 1, wherein said at least one light emitting device is capable of intermittent operation.

27. The device of claim 1 wherein said at least one motion detector, said announcement device, said warning replica and said at least one light emitting device are an integral unit.

28. The device of claim 1 wherein said at least one motion detector, said announcement device, said warning replica and said at least one light emitting device are not an integral unit.

29. The device of claim 1 wherein said transmitting means comprises at least one of hard wiring, a fiber-optic connection and wireless transmission.

30. The device of claim 1 wherein said at least one human warning sign warns of the presence of the same animal as said warning replica.

31. The device of claim 1, wherein said at least one human warning sign warns of the presence of an animal different from said warning replica.

32. The device of claim 1 wherein said at least one human warning sign warns of the presence of a dog comprising at least one of a watch dog, German Shepherd, Doberman and Rottweiller.

* * * * *